US007945202B2

(12) United States Patent
Kimura et al.

(10) Patent No.: US 7,945,202 B2
(45) Date of Patent: May 17, 2011

(54) CLEANING APPARATUS AND IMAGE FORMING APPARATUS

(75) Inventors: Takenobu Kimura, Hachioji (JP); Yotaro Sato, Hachioji (JP); Hajime Kawakami, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 66 days.

(21) Appl. No.: 12/431,171

(22) Filed: Apr. 28, 2009

(65) Prior Publication Data

US 2009/0274500 A1 Nov. 5, 2009

(30) Foreign Application Priority Data

May 1, 2008 (JP) ..... 2008-119592

(51) Int. Cl.
*G03G 21/00* (2006.01)

(52) U.S. Cl. ..... 399/353; 399/354

(58) Field of Classification Search ..... 399/38, 399/71, 107, 110, 123, 343, 353, 354; 15/256.5, 15/256, 51
See application file for complete search history.

(56) References Cited

U.S. PATENT DOCUMENTS

| | | | | |
|---|---|---|---|---|
| 4,660,962 | A * | 4/1987 | Maekawa et al. | 399/354 |
| 5,233,398 | A * | 8/1993 | Nimura et al. | 399/354 |
| 5,329,344 | A * | 7/1994 | Gerbasi et al. | 399/353 |
| 7,403,729 | B2 * | 7/2008 | Shida | 399/71 |
| 7,630,658 | B2 * | 12/2009 | Nishikawa | 399/49 |
| 7,756,462 | B2 * | 7/2010 | Iwasaki et al. | 399/357 |

FOREIGN PATENT DOCUMENTS

| | | | |
|---|---|---|---|
| JP | 2004-239999 | A | 8/2004 |
| JP | 2006-215072 | A | 8/2006 |

* cited by examiner

*Primary Examiner* — Hoan Tran
(74) *Attorney, Agent, or Firm* — Cantor Colburn LLP

(57) ABSTRACT

An cleaning apparatus includes: a first brush roll for removing toner from an image carrier; a second brush roll for removing the toner from the image carrier; a first recovery device for recovering the toner deposited on the first brush roll; a second recovery device for recovering the toner deposited on the second brush roll; a first electric field forming device for forming an electric field between the first brush roll and the image carrier; and a second electric field forming device for forming an electric field between the second brush roll and image carrier, wherein the first brush roll and the second brush roll each has a plurality of electrically conductive yarns arranged on a conductive core, and a resistance R2 of each of the yarns used in the second brush roll is smaller than $1\times10^7$ Ω/cm.

7 Claims, 5 Drawing Sheets

CLEANING APPARATUS AND IMAGE FORMING APPARATUS

RELATED APPLICATION

This application is based on Japanese Patent Application NO. 2008-119592 filed on May 1, 2008 in Japanese Patent Office, the entire content of which is hereby incorporated by reference.

FIELD OF THE INVENTION

The present invention relates to a cleaning apparatus employed in the image forming apparatus using electrophotographic process in a photocopier, printer, facsimile and multi-functional peripheral made thereof, particularly to a brush roll for removing the remaining toner from an image carrier.

DESCRIPTION OF THE RELATED ART

In the image forming apparatus using electrophotographic process in a photocopier, printer, facsimile and multi-functional peripheral made thereof, a latent image corresponding to the document is formed on a photoreceptor drum, and toner is applied to this latent image. The toner image is developed, and the developed toner image is transferred onto a recording medium. After that, the toner image transferred onto the recording medium is fixed, and the recording medium is ejected.

When a color image is formed, the latent images of Y, M, C and K colors corresponding to the document colors are formed on four photoreceptor drums, respectively, and the developed four-color toner images are transferred onto an endless intermediate transfer belt on the primary basis. After that, these images are transferred onto a recording medium on the secondary basis, and the toner images transferred onto the recording medium are fixed and the recording medium is ejected.

The image forming apparatus having the aforementioned structure is provided with a cleaning apparatus for removing the remaining toner remaining on the photoreceptor drum and intermediate transfer belt after transfer.

Such a cleaning apparatus includes a blade cleaning apparatus wherein a tabular rubber-made blade is brought in contact with the photoreceptor drum or intermediate transfer belt to remove the remaining toner mechanically. This device is characterized by a simple structure and reasonable price, and therefore, has come into widespread use.

However, this blade cleaning apparatus fails to meet the requirements when the toner of smaller particle size is used. This problem is solved by using a brush cleaning apparatus wherein a brush roll is brought in contact with the photoreceptor drum or intermediate transfer belt and remaining toner is removed by mechanical scraping force and electrostatic attraction resulting from bias voltage applied to a brush roll.

Further, the remaining toner includes the toner and paper dust having been charged reversely to the polarity of the regular toner under the influence of transfer operations, in addition to the toner having the same polarity as that of the regular toner charged to a predetermined level by the friction with a carrier or an triboelectric charging member in the development apparatus, and is characterized by an extensive range in the amount of toner charge. This arrangement makes it difficult to remove all the remaining toner by applying bias voltage to one brush roll. Thus, two brush rolls are arranged, and positive and negative voltages are applied to them, respectively, whereby the remaining toner having different polarities is removed. This type of arrangement is commonly known.

In the brush cleaning apparatus, if the remaining toner is deposited on a brush roll, rapid deterioration of cleaning performance will result. To solve this problem, a metallic recovery roll is brought in contact with the brush roll to remove the remaining toner.

The following brush cleaning apparatuses are disclosed in the Patent Documents:

The Japanese Unexamined Patent Application Publication No. 2006-215072 discloses a cleaning apparatus wherein the first and second brush rolls as two same brush rolls located at different positions in the moving direction of an intermediate transfer member are rotated and rubbed against each other, whereby the remaining toner is removed from the intermediate transfer member. To ensure electrostatic attraction of the remaining toner having the same polarity (negative in this case) as that of the regular toner, positively charged bias voltage is applied to the second brush roll on the upstream side. To remove the remaining toner having the polarity (positive in this case) reverse to that of the regular toner, negatively charged bias voltage is applied to the first brush roll on the downstream side. However, when a patch image is formed or there is a large quantity of the remaining toner having the same polarity as that of the regular toner as in the case immediately after paper jamming, a large quantity of toner remains unremoved on the second brush roll. To remove this toner, positively charged bias voltage is applied to the first brush roll on the downstream side as well.

The Japanese Unexamined Patent Application Publication No. 2004-239999 discloses a technique that uses a polarity control device arranged to inject the electric charge having the same polarity as that of the regular toner, into the toner on the image carrier on the upstream side with respect to the second fur brush 13*b* for major cleaning. The first fur brush having a lower volume resistivity than that of the second fur brush is used as a polarity control device. The first fur brush has a volume resistivity of $10^2$ through $10^7$ Ω·cm, and the second fur brush has a volume resistivity of $10^5$ through $10^{10}$ Ω·cm. The first fur brush 13*a* is not intended to remove toner from the image carrier. It is designed to ensure that the polarity of the toner having been changed to have the polarity reverse to that of the regular toner by the processing transfer is put back to the same polarity as that of the regular toner, and the remaining toner of the polarity that cannot be removed by the second fur brush is minimized.

The technique of the Japanese Unexamined Patent Application Publication No. 2006-215072 requires complicated status management and control wherein the bias voltage is switched in response to the toner remaining on the intermediate transfer member (on the image carrier). Immediately after the polarity of the bias voltage applied to the first brush roll on the downstream side has been switched, the toner deposited on the brush is ejected onto the intermediate transfer member. This trouble occurs at the same time, and therefore, requires some control means to be provided to solve the problem.

Under these circumstances, there has been a intense demand for a brush roll cleaning apparatus capable of ensuring that various forms of remaining toner ranging from a large quantity of toner in multiple layers to a mixture of positively and negatively charged toner particles are completely removed from the image carrier, without requiring the complicated control described in the Japanese Unexamined Patent Application Publication No. 2006-215072.

The technique of the Japanese Unexamined Patent Application Publication No. 2004-239999 uses the cleaning apparatus wherein electrostatic attraction of toner from the image carrier is provided only by the second fur brush on the downstream side. Thus, bias voltage is applied so as not to allow reversely charged toner to be generated by discharging, and the toner removing capacity of the fur brush per unit area cannot be increased sufficiently. Accordingly, satisfactory cleaning of the region containing a large quantity of toner in multiple layers requires the rotational speed of the second fur brush to be increased. In this sense, this technique involves a problem with speed increase.

In view of the prior art problems described above, it is an object of the present invention to provide a brush roll cleaning apparatus of double brush type capable of completely removing the remaining toner ranging from a large quantity of toner to a mixture of positively and negatively charged toner particles, this brush roll cleaning apparatus meeting the requirements for speed increase, without depending on complicated control.

SUMMARY OF THE INVENTION

The present invention has one aspect to solve the above problems and an object of the present invention is to provide a cleaning apparatus including:

a first brush roll which removes toner remaining on an image carrier from the image carrier;

a second brush roll which removes the toner remaining on the image carrier, and is located on a downstream of the first brush roll in a moving direction of the image carrier;

a first recovery device which recovers the toner deposited on the first brush roll;

a second recovery device which recovers the toner deposited on the second brush roll;

a first electric field forming device which forms an electric field between the first brush roll and the image carrier, the first electric field being capable of transferring the toner of the image formed on the image carrier from the image carrier to the first brush roll; and a second electric field forming device which forms an electric field between the second brush roll and image carrier, electric field being capable of transferring the toner which has a polarity reverse to a polarity of the toner of the image formed on the image carrier and is deposited on the image carrier from the image carrier to the second brush roll, wherein the first brush roll and the second brush roll each has a configuration of a plurality of electrically conductive yarns arranged on a conductive substrate in a form of a brush, and a resistance R2 of each of the yarns used in the second brush roll is smaller than $1\times10^7$ Ω/cm.

BRIEF DESCRIPTION OF THE DRAWINGS

This and other objects, advantages and features of the invention will become apparent from the following description thereof taken in conjunction with the accompanying drawings in which.

DETAILED DESCRIPTION OF THE PREFERRED EMBODIMENT

Figure 1:
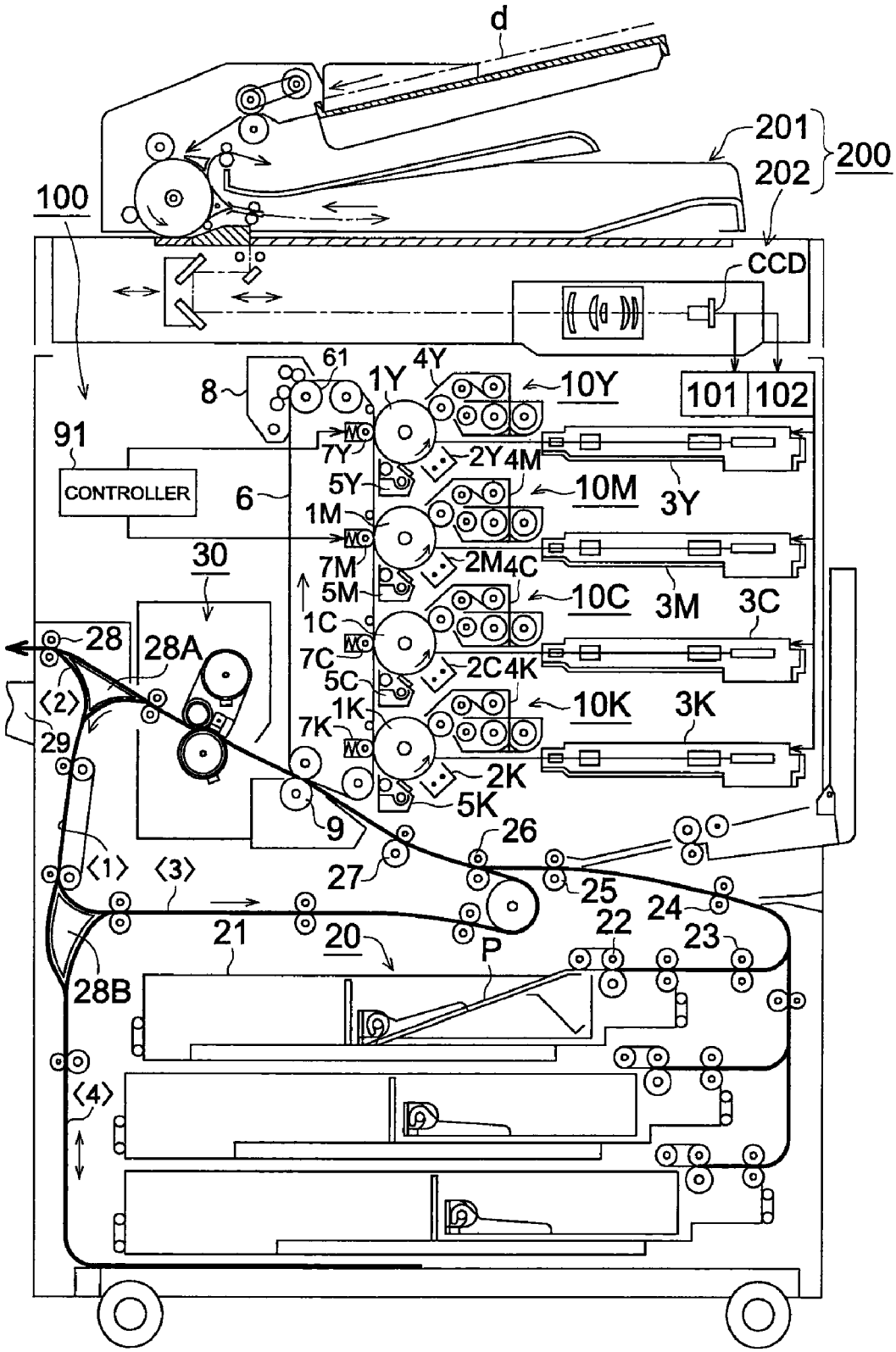
FIG. 1 is a cross sectional view schematically showing the structure of the image forming apparatus using the cleaning apparatus of the present invention.

Referring to the schematic diagram of FIG. 1, the following describes an example of the image forming apparatus using the present invention.

The color image forming apparatus of FIG. 1 includes an image forming apparatus 100 and image reading apparatus 200.

The image forming apparatus 100 is what is called the tandem type color image forming apparatus, and includes a plurality of image forming devices 10Y, 10M, 10C and 10K, a belt-like intermediate transfer belt 6, a sheet feed/conveyance device 20, and a belt fixing apparatus 30 to be described later.

An image reading apparatus 200 containing an automatic document feeder 201 and document image scanning exposure apparatus is mounted on the image forming apparatus 100.

The document d placed on the document platen of the automatic document feeder 201 is conveyed by a conveyance device. The image on one side or both sides of the document is exposed and scanned by the optical system of the document image scanning exposure apparatus 202 and is read into the line image sensor CCD.

The image processing section 101 applies analog processing, analog-to-digital conversion, shading correction and image compression processing to the analog signal having been subjected to photoelectric conversion by the line image sensor CCD. After that, the signal is inputted into the exposure devices 3Y, 3M, 3C and 3K.

The image forming devices 10Y forming the yellow (Y) image includes a charging device 2Y, exposure device 3Y, development apparatus 4Y and photoreceptor cleaning apparatus 5Y arranged around the photoreceptor drum 1Y as an image carrier. The image forming devices 10M for forming a magenta (M) color image includes a photoreceptor drum 1M as an image carrier, charging device 2M, exposure device 3M, development apparatus 4M and photoreceptor cleaning apparatus 5M. The image forming devices 10C for forming a cyan (C) color image includes a photoreceptor drum 1C as an image carrier, charging device 2C, exposure device 3C, development apparatus 4C and photoreceptor cleaning apparatus 5C. The image forming devices 10K for forming a black (K) color image includes a photoreceptor drum 1K as an image carrier, charging device 2K, exposure device 3K, development apparatus 4K and photoreceptor cleaning apparatus 5K. The charging device 2Y and exposure device 3Y, charging device 2M and exposure device 3M, charging device 2C and exposure apparatus 3C, and charging device 2K and exposure apparatus 3K constitute a latent image forming device.

The development apparatuses 4Y, 4M, 4C and 4K include two-component developers made up of small-diameter toner particles of yellow (Y), magenta (M), cyan (C) and black (K) colors and carriers.

The intermediate transfer belt 6 is made of polyimide, and has a volume resistivity of $1\times10^7$ through $1\times10^{11}$ Ω·cm, and a surface resistance of $10^{11}\Omega$. The intermediate transfer belt 6 is wound around a plurality of rolls such as a backup roll 61, and is rotatably supported.

The color images formed by the image forming devices 10Y, 10M, 10C and 10K are sequentially transferred onto the rotating intermediate transfer belt 6 by the primary transfer devices 7Y, 7M, 7C and 7K (primary transfer), whereby a composite color image is formed.

The recording medium P stored in the sheet feed cassette 21 of the sheet feed/conveyance device 20 is fed by the sheet feed device 22, and is conveyed to the transfer roll 9 through the sheet feed rolls 23, 24, 25 and 26, and registration roll 27, whereby the color image of the intermediate transfer belt 6 is transferred onto the recording medium P (secondary transfer).

The recording medium P with the color image transferred thereon is nipped at the belt fixing apparatus 30, and is exposed to heat and pressure, whereby the toner image on the recording medium P is fixed and secured on the recording medium P, and is sandwiched by the ejection roll 28. After that, the recording medium P is placed on the ejection tray 29 outside the apparatus.

In the meantime, after the color image has been transferred onto the recording medium P by the transfer roll 9, the recording medium P is subjected to curvature-separation by the intermediate transfer belt 6 and the remaining toner is removed from the intermediate transfer belt 6 by the cleaning apparatus 8.

When the recording medium P having been fixed is reversed and ejected, the recording medium P passes through the sheet conveyance path (on the right of the drawing) of the branching plate 28A arranged between the belt fixing apparatus 30 and ejection roll 28, and is conveyed to the first sheet conveyance path <1> located below. The recording medium P then passes through the second sheet conveyance path <2> (on the left of the drawing) of the branching plate 28A, and is ejected out of the apparatus by the ejection roll 28.

When an image is copied on both surfaces of the recording medium P, the recording paper P having been fixed is conveyed to the first sheet conveyance path <1>, then to the 4th sheet conveyance path <4> below the branching plate 28B. The recording medium P is reversed and conveyed, and passes through the sheet conveyance path (on the right of the drawing) of the branching plate 28B. After passing through the third sheet conveyance path <3>, the recording medium P makes a detour and travels upward. It is then conveyed by the sheet feed roll 26. Color images are formed on the second surface of the recording medium P by the image forming devices 10Y, 10M, 10C and 10K, and are heated and fixed by the belt fixing apparatus 30, whereby the recording medium P is ejected out of the apparatus by the ejection roll 28.

In the above description, the image forming apparatus has been shown as a color image forming apparatus. However, it can be a monochromatic image forming apparatus if an intermediate transfer belt is used.

Figure 2:
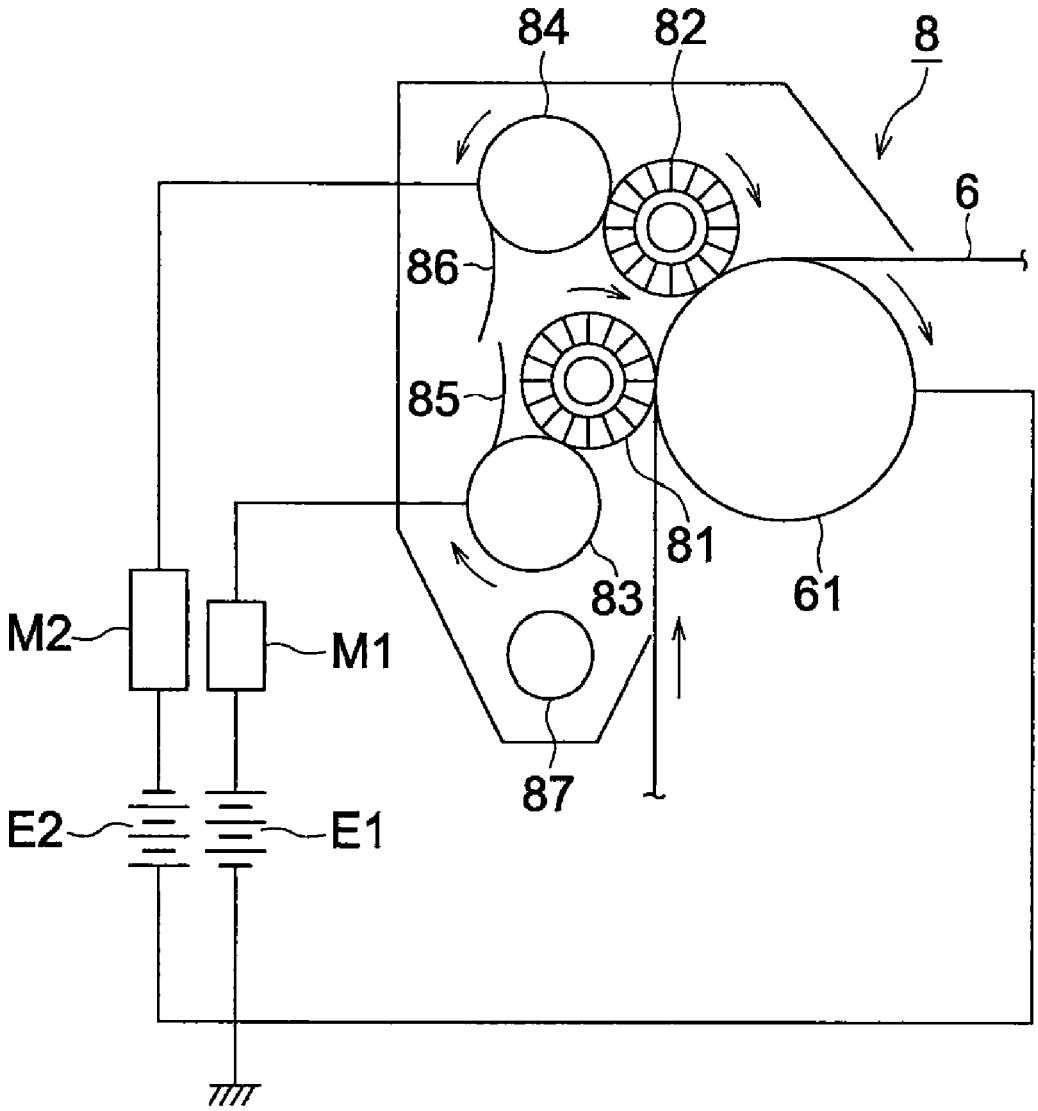
FIG. 2 is a cross sectional view schematically showing the structure of the cleaning apparatus of the present invention.

Referring to the cross sectional view of FIG. 2, the following describes the cleaning apparatus 8 of the present invention:

The reference number 6 denotes the aforementioned intermediate transfer belt, and 61 indicates the aforementioned backup roll made of aluminum.

Both the first brush roll 81 rotating in the clockwise direction and the second brush roll 82 are pressed against the intermediate transfer belt 6, and the remaining toner deposited on the intermediate transfer belt 6 is removed by the cleaning apparatus 8. The second brush roll 82 is installed on the downstream side in the traveling direction of the intermediate transfer belt with respect to the first brush roll 81.

The first brush roll 81 and second brush roll 82 have an outer diameter of 18 mm, and are each made up of an aluminum-made cored bar having an outer diameter of 5 mm wherein a brush implanted with hairs having a length of 5 mm.

These brush hairs for the both rolls are made of a conductive nylon as basic material with a diameter of 6 d, and a yarn density of 100 kF/inch$^2$, wherein "d" denotes "denier", which represents a unit of fiber density. One denier indicates the density of the fiber having a length of 9,000 m and a mass of 1 g. The brush yarn resistance constitutes a major factor of the present invention, and the details will be described later with reference to the description of tests.

Although the brush is made of nylon fiber, a conductive fiber such as acryl, polyester or polyethylene can be used.

The first brush roll 81 is brought in contact with a first recovery roll 83 with a penetration of 1 mm, and is rotated. Since a first scraper 85 is brought in contact with the first recovery roll 83 in the counter direction, the remaining toner deposited on the first brush roll 81 is recovered by the first recovery roll 83. After that, the remaining toner having been recovered is scraped off from the first recovery roll 83 by the first scraper 85.

Similarly, the second recovery roll 84 is brought in contact with the second brush roll 82 with a penetration of 1 mm. Accordingly, the remaining toner deposited on the second brush roll 82 is recovered by the second recovery roll 84. After that, the remaining toner having been recovered is scraped off from the second recovery roll 84 by the second scraper 86.

The first recovery roll 83 and the second recovery roll 84 are conductive rolls, and are made of metallic rolls formed of stainless steel or resin rolls whose surfaces are processed to become conductive. The first scraper 85 and the second scraper 86 are made of stainless steel plates having a thickness of about 0.05 mm.

The remaining toner scraped off by the first scraper 85 and second scraper 86 is conveyed outside the cleaning apparatus 8 in the direction perpendicular to the sheet surface by the recovery screw 87 located below and is collected into a recovery container (not illustrated).

The first brush roll 81 and second brush roll 82 are brought in contact with the intermediate transfer belt 6 with a penetration of 1 mm, and are moved reverse to the traveling direction of the intermediate transfer belt 6 at the contact position. They are rotated at a linear velocity of 220 mm/sec. The intermediate transfer belt moves at a linear velocity of 220 mm/sec, with a relative linear velocity of 440 mm/sec.

The frictional force of the aforementioned relative linear velocity applies a mechanical action to the remaining toner on the image carrier and contributes to cleaning of the remaining toner.

The following describes the structure of forming an electric field between the first brush roll and intermediate transfer belt 6:

The first brush roll 81 together with the cored bar is electrically floated. The first recovery roll 83 is connected to one end of the first power source E1 whose other end is grounded, whereby positively charged bias voltage is applied. A closed circuit is formed in such a way that the first power source E1, the first recovery roll 83, the first brush roll 81, the intermediate transfer belt 6, the backup roll 61, the ground and the first power source E1 are connected in that order. The current flowing through this closed circuit is monitored by an ammeter M1.

Similarly, the second brush roll 82 together with the cored bar is electrically floated. The second recovery roll 84 is connected to one end of the second power source E2 whose other end is grounded, whereby negatively charged bias voltage is applied. A closed circuit is formed in such a way that the second power source E2, the second recovery roll 84, the second brush roll 82, intermediate transfer belt 6, backup roll 61, the ground and the second power source E2 are connected in that order. The current flowing through this closed circuit is monitored by an ammeter M2.

The following describes the first power source E1 and the first brush roll 81: When the bias voltage outputted from the first power source E1 is increased, the current monitored by the ammeter M1 is also increased, and the electric field between the first brush roll 81 and intermediate transfer belt 6 is increased. When the monitored current, i.e., bias current (bias voltage) is increased, there is an increase in the electrostatic force to attract the negatively charged toner (having the same polarity as that of the regular toner) remaining on the intermediate transfer belt 6, toward the first brush roll 81. Namely, when the bias current is increased, there is an increase of the electrostatic force to remove the negatively charged toner from the intermediate transfer belt 6. In the meantime, there is an increase in the electrostatic force to repel the positively charged toner (toner having the polarity reverse to that of the regular toner) from the first brush roll 81, and a decrease in the electrostatic force to remove the toner from the intermediate transfer belt 6.

Similarly, the following describes the second power source E2 and the second brush roll 82: When the bias current (bias voltage) is increased, there is an increase in the electrostatic force to attract the positively charged toner (toner having the polarity reverse to that of the regular toner) remaining on the intermediate transfer belt 6, toward the first brush roll 81. Namely, when the bias current is increased, there is an increase in the electrostatic force to remove the positively charged toner from the intermediate transfer belt 6. In the meantime, there is an increase in the electrostatic force to repel the negatively charged toner (toner having the same polarity as that of the regular toner) from the first brush roll 81, and a decrease in the electrostatic force to remove the negatively charged toner from the intermediate transfer belt 6.

When the yarn resistance value of the brush roll has been changed over a wide range ($10^2$ Ω/cm through $10^{12.5}$ Ω/cm), bias current has better correlativity than bias voltage with respect to the removing capacity (cleaning performance) of the remaining toner. The first power source E1 and second power source E2 are specified in terms of output currents.

The present invention was subjected to a history of various studies and was obtained by repeating trial-and-errors and experiments of various kinds of combinations regarding to yarn resistance and cleaning performances, with taking attention to yarn resistances of the first brush roll 81 and the second brush roll 82.

The yarn resistance R can be measured as follows: Electrodes are provided at intervals of 15 mm in the course of feeding the bundled yarn in the yarn winding process. A constant voltage V is applied to these electrodes, and current value I is obtained. Thus, the yarn resistance R is calculated according to the following formula:

$$R=V/(1.5\times I)$$

A bundle of yarn in this case is defined as a bundle when base cloth is implanted with yarn. For the 6 d yarn, for example, 48 filaments constitutes one bundle.

Non-transfer test and transfer-residual test are used to verify the cleaning performance of the cleaning apparatus 8. For practicable use, it is mandatory to conduct the non-transfer test and pass this test. It is also mandatory to conduct the transfer-residual test, but it is not necessarily required to pass this test. However, it is preferred to pass both tests. If the non-transfer test requirement has been met, there is no need of taking special measures for a large quantity of toner remaining after a paper jam or creation of a patch image. It is possible to provide easy-to-use cleaning apparatus characterized by high speed and excellent stability.

The following describes the present embodiment of the monochromatic image forming apparatus for forming a monochromatic image.

The non-transfer test is conducted according to the following procedures:

(1) When the non-transfer test (test mode 1) is selected and the operation start button is depressed, the image forming apparatus 1 starts the test mode 1 wherein solid images are formed over the image area and non-image area of the intermediate transfer belt 6 on a continuous base, and the solid image is directly cleaned by the cleaning apparatus 8. When operations are performed in the test mode 1, the apparatus is placed in the non-transfer status wherein the sheet P is not fed and the transfer roll 9 is separated from the belt.

The above-mentioned test mode 1 will be deactivated upon arrival of the time corresponding to the time of printing continuous 100 sheets. The control ROM provided with this test mode 1 is installed on the image forming apparatus 1 before the cleaning test starts.

According to the aforementioned steps, a sample of the solid patch image is obtained, wherein toner still remains without being removed by the cleaning apparatus 8.

This solid image is the K-color toner solid image. The solid image is adjusted in such a way that the amount of deposition will be about 5 g/$m^2$.

(2) Then the intermediate transfer unit is pulled out and the adhesive side of the transparent tape (e.g., mending tape by 3M Co., Ltd.) is pressed against the sample surface. The transparent tape is separated and is pasted on the reference paper. Then the reflection density of this reference paper is measured. This reflection density is used to measure the cleaning performance under various conditions of each cleaning apparatus.

The reflection density indicates the relative density wherein the reference value uses the reflection density when a transparent tape is directly attached to the reference paper.

The cleaning performance is evaluated as "GOOD" when the reflection density does not exceed 0.005, and "NO GOOD" when the reflection density exceeds 0.005.

The following describes the procedure of the transfer-residual test. There is a difference from the non-transfer test in the sample preparation method, which alone will be explained:

(1) When the transfer-residual test (test mode 2) has been selected and the operation start button has been depressed, the image forming apparatus 1 starts the test mode 2 wherein the K-color solid image and K-color half tone image are formed alternately in the image area of the intermediate transfer belt 6. In this test mode, the sheet P is fed and the transfer roll 9 is brought in contact. The apparatus is kept in the normal transfer status.

The test mode 2 is deactivated immediately after the image area of 100-th image forming operation has passed through the cleaning apparatus 8.

As shown above, when images have been formed on a continuous basis under severe conditions for cleaning the surface, a sample is obtained wherein toner still remains without being removed by the cleaning apparatus 8. After transfer, the transfer-residual toner remaining on the intermediate transfer belt 6 is subjected to the impact of transfer, and there is a mixture of positively and negatively charged toner particles, although the quantity is small.

The control ROM provided with the aforementioned test mode is installed on the image forming apparatus 1 before the cleaning test starts.

The aforementioned K-color half tone image exhibits a dot pattern adjusted in such a way that the amount of deposition will be about 2 g/m$^2$. The K-color solid image also exhibits a pattern adjusted in such a way that the amount of deposition will be about 5 g/m$^2$.

(2) The reflection density of the transparent tape is evaluated in the same way as that in the non-transfer patch test, and will not be described.

The following describes an example of evaluating the cleaning performance of the cleaning apparatus 8 wherein the yarn resistance R1 of the first brush roll 81 is combined with the yarn resistance R2 of the second brush roll 82.

A cleaning test is conducted by setting the output current value $I_1$ of the power source E1 and the output current value $I_2$ of the power source E2 variable independently, thereby identifying the relationship between each output current value and the cleaning performance (reflection density after sufficient cleaning) in each test. The combinations of R1 and R2 wherein the "GOOD" level (the reflection density does not exceed 0.005) cannot be obtained in the range of all possible combinations between the output current value $I_1$ and output current value $I_2$ are evaluated as "NO GOOD". To put it another way, if "GOOD" level (the reflection density does not exceed 0.005) is obtained in the combinations between the output current value $I_1$ and output current value $I_2$, the combinations between R1 and R2 are evaluated as "GOOD".

Figure 3:
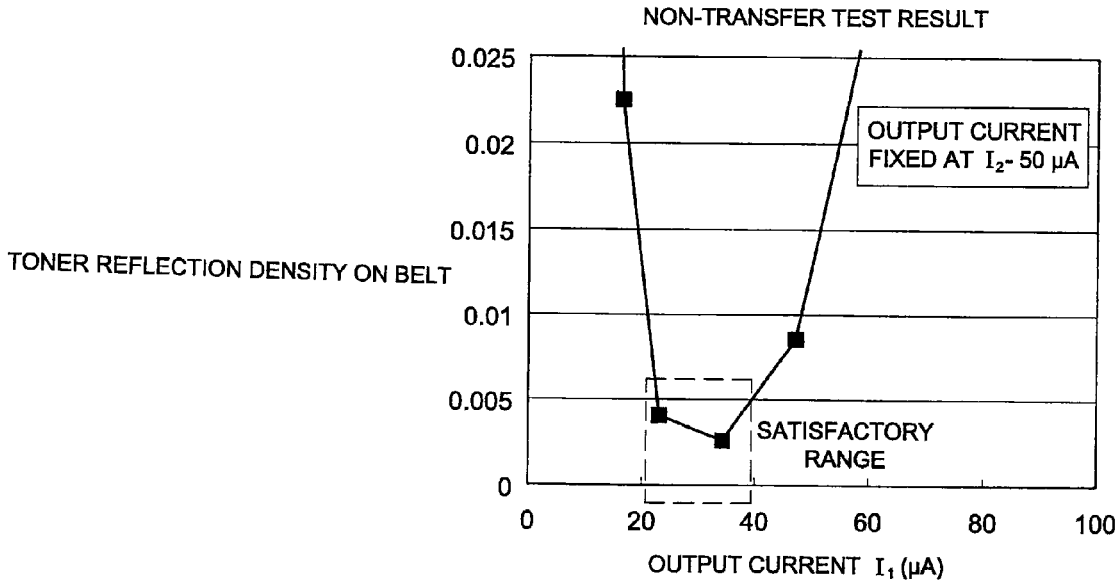
FIG. 3 is a chart graphically representing an example of the non-transfer test in the present invention.

FIG. 3 is a chart graphically representing an example of the cleaning performance in the non-transfer test on the first brush roll 81 having a certain yarn resistance R1 and the second brush roll 82 having a certain yarn resistance R2. The output current value $I_1$ is plotted on the horizontal axis, and the reflection density for the toner remaining after cleaning is plotted on the vertical axis. In this case, the output current value $I_2$ is −50 μA. Namely, it shows the relationship between the output current value $I_1$ and cleaning performance when the output current value $I_2$=−50 μA.

The result shows that, in the range of 20 μA≦$I_1$≦40 μA (for $I_2$=−50 μA), at least the cleaning performance with a density not exceeding 0.005 is obtained in the non-transfer test, and cleaning performance is evaluated as "GOOD". Thus, the combination of the yarn resistance R1 and yarn resistance R2 of this combination is evaluated as "GOOD" in the non-transfer test.

Figure 4:
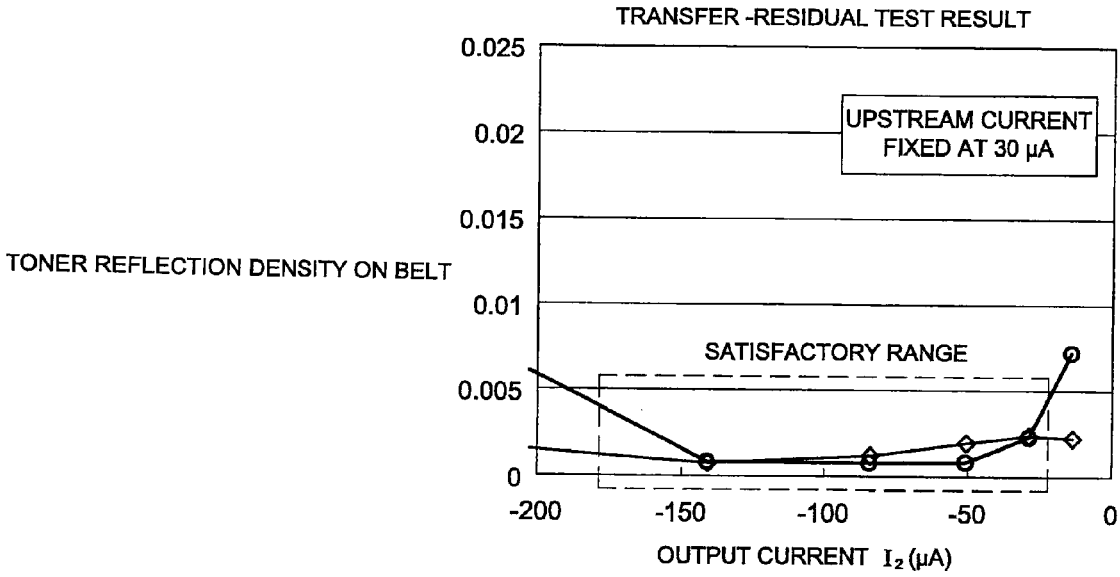
FIG. 4 is a chart graphically representing an example of the transfer-residual test in the present invention.

FIG. 4 is a chart graphically representing an example of the cleaning performance in the transfer-residual test on the first brush roll 81 having a certain yarn resistance R1 and the second brush roll 82 having a certain yarn resistance R2. It shows the relationship between the output current value $I_1$ and cleaning performance when the output current value $I_1$=30 μA. The broken line indicates the reflection density in the half tone image portion remained after cleaning and the solid line shows the reflection density in the solid image portion remained after cleaning.

The above study shows that, in the range $I_2$ of −180 μA or more without exceeding −25 μA, the result of the transfer-residual test is evaluated as "GOOD". Thus, the combination between the yarn resistance R1 and yarn resistance R2 is evaluated as "GOOD" in the transfer-residual test, because there is an area of the output current value wherein the cleaning performance is "GOOD".

Figure 5:
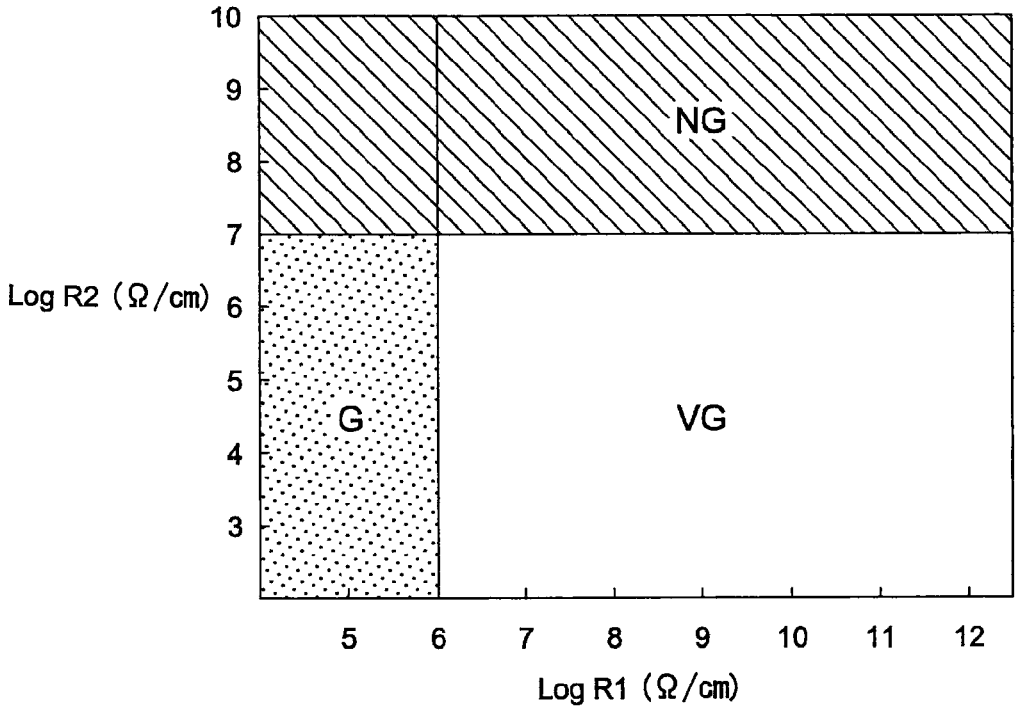
FIG. 5 is a chart graphically representing the result of overall evaluation (Part 1) on the combination of the yarn resistances of both brush rolls of the present invention.

FIG. 5 is a chart graphically representing the result of overall evaluation of the cleaning performance in the combination between the yarn resistance R1 of the first brush roll 81 and the yarn resistance R2 of the second brush roll 82 in the possible range.

For the yarn resistance R1 of the first brush roll 81, a resistance value in the range of $10^4$ through $10^{12.5}$ Ω·cm was selected. For the yarn resistance R2 of the second brush roll 82, a resistance value in the range of $10^2$ through $10^{10}$ Ω·cm was selected. FIG. 5 gives the result of conducting the non-transfer test illustrated in FIG. 3 and the transfer-residual test illustrated in FIG. 4 for each of the combinations.

The following describes FIG. 5:

The yarn resistance R1 (logarithmic representation) of the first brush roll 81 is plotted on the horizontal axis, and the yarn resistance R2 (logarithmic representation) of the second brush roll 82 is plotted on the vertical axis.

The hatched area marked with "NG" indicates the range of the combination between the yarn resistance R1 of the first brush roll 81 and the yarn resistance R2 of the second brush roll 82 which has been evaluated as "NO GOOD" in the transfer-residual test.

The dotted area marked with "G" and the white area marked with "VG" indicate the range of the combination between the yarn resistance R1 of the first brush roll 81 and the yarn resistance R2 of the second brush roll 82 which has been evaluated as "GOOD" in the transfer-residual test.

The white area marked with "VG" indicate the range of the combination between the yarn resistance R1 of the first brush roll 81 and the yarn resistance R2 of the second brush roll 82 which has been evaluated as "GOOD" in both the transfer-residual test and non-transfer test.

Thus, it has been revealed that the combination between the yarn resistance R1 of the first brush roll 81 and the yarn resistance R2 of the second brush roll 82 capable of meeting the requirements of the transfer-residual test which is mandatory at least for the practical use of the cleaning apparatus is found within the range of the following conditional expression:

$$R2<1\times10^7\ \Omega/\text{cm} \quad (1)$$

wherein R1 is applicable in the range of all the resistance values, without any restriction.

It has also been revealed that the combinations between the yarn resistance R1 of the first brush roll 81 and the yarn resistance R2 of the second brush roll 82 that provides a cleaning apparatus capable of meeting the requirements of the above-mentioned transfer-residual test and non-transfer test and characterized by high speed, excellent stability and easy use are found within the following conditional expression:

$$R1>1\times10^6\ \Omega/\text{cm, and} \quad (1)$$

$$R2<1\times10^7\ \Omega/\text{cm} \quad (2)$$

The following describes the applicability of the present invention to the color image forming apparatus for forming a color image, with reference to the test and results thereof:

The following describes the non-transfer test procedures:

(1) When the non-transfer test (test mode 3) has been selected and the operation start button has been depressed, the test mode 3 is activated in such a way that two-color solid images are formed on a continuous basis over the image range and non-image range of the intermediate transfer belt 6, and these two-color images are directly cleaned by the cleaning apparatus 8. In this test mode 3, the sheet P is not fed and the transfer roll 9 is separated from the belt.

The above-mentioned test mode 3 will be deactivated upon arrival of the time corresponding to the time of printing continuous 100 sheets. The control ROM provided with this test mode 3 is installed on the image forming apparatus 1 before the cleaning test starts.

According to the aforementioned steps, a sample of the two-color solid patch image is obtained, wherein toner still remains without being removed by the cleaning apparatus 8.

The aforementioned two-color solid image is a solid image formed by the C-color toner solid image superimposed on the M-color toner solid image. The aforementioned M-color toner and C-color toner solid images are adjusted in such a way that the amount of deposition is about 5 g/m$^2$. Thus, the two-color solid image formed by the C-color toner solid image superimposed on the M-color toner has a deposition of about 10 g/m$^2$.

(2) Then the intermediate transfer unit is pulled out and the adhesive side of the transparent tape (e.g., mending tape by 3M Co., Ltd.) is pressed against the sample surface. The transparent tape is separated and is pasted on the reference paper. Then the reflection density of this reference paper is measured. This reflection density is used to measure the cleaning performance under various conditions of each cleaning apparatus.

The reflection density indicates the relative density wherein the reference value uses the reflection density when a transparent tape is directly attached to the reference paper.

In the above-mentioned test, the M-color toner is formed in the lower layer on the intermediate transfer member, and the M-color toner remains after insufficient cleaning. Accordingly, the magenta density is selected.

The cleaning performance is evaluated as "GOOD" when the reflection density does not exceed 0.005, and "NO GOOD" when the reflection density exceeds 0.005.

The following describes the procedure of the transfer-residual test. There is a difference from the non-transfer test in the sample preparation method, which alone will be explained:

(1) When the transfer-residual test (test mode 4) has been selected and the operation start button has been depressed, the image forming apparatus 1 starts the test mode 4 wherein the two-color solid image and two-color half tone image are formed alternately in the image area of the intermediate transfer belt 6. In this test mode 4, the sheet P is fed and the transfer roll 9 is brought in contact with the belt. The apparatus is kept in the normal transfer status.

The test mode 4 suspends the image forming apparatus 1 immediately after the image area of 100-th image forming operation has passed through the cleaning apparatus 8.

When the transfer-residual toner has been repeated on a continuous basis in the aforementioned manner, a sample of the image is obtained, wherein toner still remains without being removed by the cleaning apparatus 8. The transfer-residual toner is subjected to the impact of transfer, and there is a mixture of positively and negatively charged toner particles, although the quantity is small.

The control ROM provided with the aforementioned test mode is installed on the image forming apparatus 1 before the cleaning test starts.

The aforementioned two-color solid image is made up of a solid image formed by the C-color toner solid image superimposed on the M-color toner solid image, and a half tone image formed by the C-color toner half tone image superimposed on the M-color toner half tone image. The half tone images of both the M-color toner and C-color toner are adjusted in such a way that the amount of deposition is about 2 g/m$^2$. Similarly, the solid images of M-color toner and C-color toner are adjusted in such a way that the amount of deposition is about 5 g/m$^2$.

(2) The reflection density of the transparent tape is evaluated in the same way as that in the non-transfer patch test, and will not be described.

Figure 6:
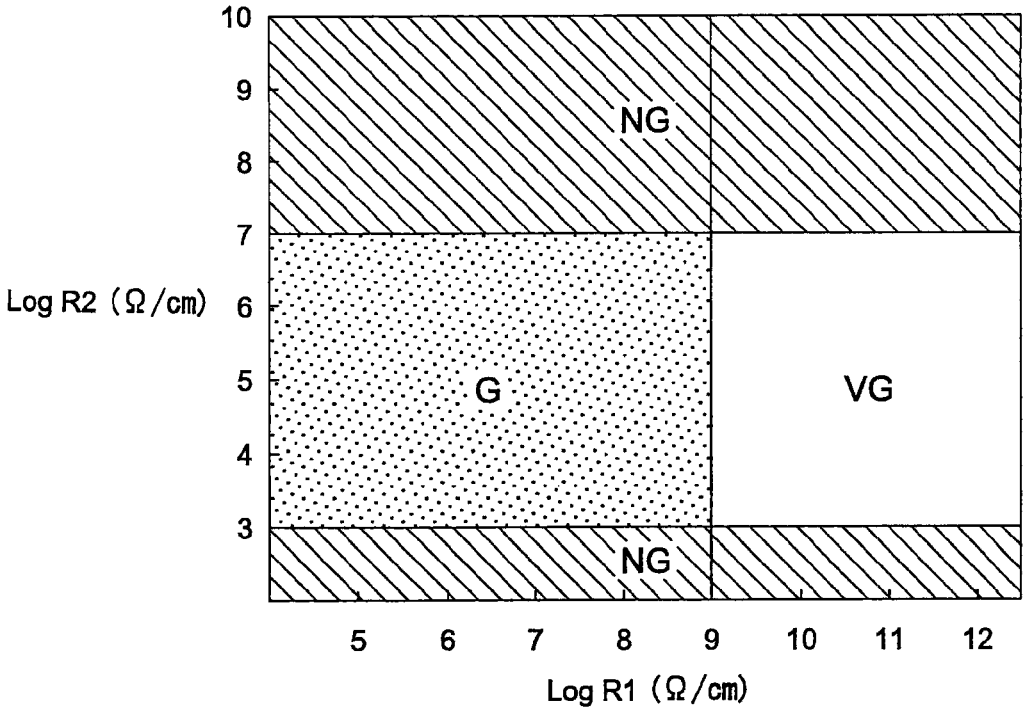
FIG. 6 is a chart graphically representing the result of overall evaluation (Part 2) on the combination of the yarn resistances of both brush rolls of the present invention.

FIG. 6 is a chart graphically representing the result of overall evaluation of the cleaning performance in the combination between the yarn resistance R1 of the first brush roll 81 and the yarn resistance R2 of the second brush roll 82 in the possible range.

For the yarn resistance R1 of the first brush roll 81, a resistance value in the range of $10^4$ through $10^{12.5}$ Ω/cm was selected. For the yarn resistance R2 of the second brush roll 82, a resistance value in the range of $10^2$ through $10^{10}$ Ω/cm was selected. FIG. 6 gives the result of conducting the non-transfer test illustrated in FIG. 3 and the transfer-residual test illustrated in FIG. 4 for each of the combinations.

The following describes FIG. 6.

The yarn resistance R1 (logarithmic representation) of the first brush roll 81 is plotted on the horizontal axis, and the yarn resistance R2 (logarithmic representation) of the second brush roll 82 is plotted on the vertical axis.

The hatched area marked with "NG" indicates the range of the combination between the yarn resistance R1 of the first brush roll 81 and the yarn resistance R2 of the second brush roll 82 which has been evaluated as "NO GOOD" in the transfer-residual test.

The dotted area marked with "G" and the white area marked with "VG" indicate the range of the combination between the yarn resistance R1 of the first brush roll 81 and the yarn resistance R2 of the second brush roll 82 which has been evaluated as "GOOD" in the transfer-residual test.

The white area marked with "VG" indicate the range of the combination between the yarn resistance R1 of the first brush roll 81 and the yarn resistance R2 of the second brush roll 82 which has been evaluated as "GOOD" in both the transfer-residual test and non-transfer test.

Thus, it has been revealed that the combination between the yarn resistance R1 of the first brush roll 81 and the yarn resistance R2 of the second brush roll 82 capable of meeting the requirements of the transfer-residual test which is mandatory at least for the practical use of the cleaning apparatus of a color image forming apparatus is found within the range of the following conditional expression:

$$R2<1\times10^6\ \Omega/\text{cm and } R2>1\times10^3\ \Omega/\text{cm} \quad (1)$$

wherein R1 is applicable in the range of all the resistance values without any restriction.

It has also been revealed that the combinations between the yarn resistance R1 of the first brush roll 81 and the yarn resistance R2 of the second brush roll 82 capable of meeting the requirements of the above-mentioned transfer-residual test and non-transfer test mandatory at least in providing a cleaning apparatus of the color image forming apparatus characterized by high speed, excellent stability and easy use are found within the following conditional expression:

$$R1>1\times10^9\ \Omega/\text{cm} \quad (1)$$

$$R2<1\times10^6\ \Omega/\text{cm, and } R2>1\times10^3\ \Omega/\text{cm} \quad (2)$$

Figure 7:
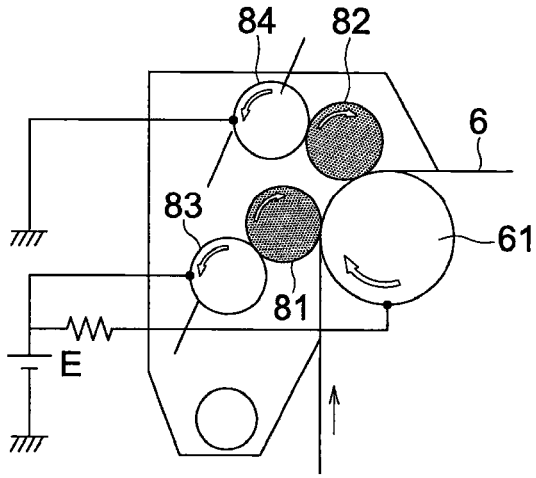
FIGS. 7(*a*) and 7(*b*) are schematic diagrams representing a single bias power source used in the cleaning apparatus of the present invention.
Figure 7:
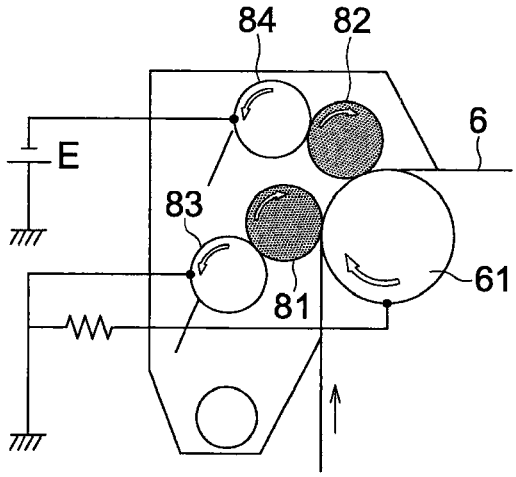

The structures of the first and second power sources for forming electric field between the first brush roll and intermediate transfer belt 6 has already been described with reference to FIG. 2. It is also possible to provide either the first or second power source, as shown in FIGS. 7 (*a*) and (*b*).

The cleaning apparatus of the present embodiment completely removes the remaining toner ranging from a large quantity of toner in multiple layers to a mixture of positively and negatively charged toner particles, without depending on complicated control.

What is claimed is:

1. A cleaning apparatus comprising:

a first brush roll which removes toner remaining on an image carrier from the image carrier;

a second brush roll which removes the toner remaining on the image carrier, and is located on a downstream of the first brush roll in a moving direction of the image carrier;

a first recovery device which recovers the toner deposited on the first brush roll;

a second recovery device which recovers the toner deposited on the second brush roll;

a first electric field forming device which forms an electric field between the first brush roll and the image carrier, the first electric field being capable of transferring the toner of the image formed on the image carrier from the image carrier to the first brush roll; and a second electric field forming device which forms and electric field between the second brush roll and the image carrier, the electric field being capable of transferring the toner which has a polarity reverse to a polarity of the toner of the image formed on the image carrier and is deposited on the image carrier from the image carrier to the second brush roll, wherein the first brush roll and the second brush roll each has a configuration of a plurality of electrically conductive yarns arranged on a conductive substrate in a form of a brush, and a resistance R2 of each of the yarns used in the second brush roll is smaller than $1\times10^7$ Ω/cm.

2. The cleaning apparatus described in claim 1, wherein a resistance R1 of each of the yarns used in the first brush roll is larger than $1\times10^6$ Ω/cm.

3. The cleaning apparatus described in claim 1, wherein the resistance R2 of each of the yarns used in the second brush roll is larger than $1\times10^3$ Ω/cm.

4. The cleaning apparatus described in claim 1, wherein the resistance R1 of each of the yarns used in the first brush roll is larger than $1\times10^9$ Ω/cm.

5. The cleaning apparatus described in claim 1, wherein first brush roll is electrically floated, and the first electric field forming device apples a voltage to the first recovery device, thereby forming the electric field between the first brush roll and the image carrier which enables the toner of the image formed on the image carrier to be transferred from the image carrier to the first brush roll.

6. The cleaning apparatus described in claim 1, wherein the second brush roll is electrically floated and the second electric field forming device apples a voltage to the second recovery device, thereby forming the electric field between the second brush roll and the image carrier which enables the toner which has a polarity reverse to a polarity of the toner of the image formed on the image carrier and is deposited on the image carrier to be transferred from the image carrier to the second brush roll.

7. An image forming apparatus comprising the cleaning apparatus described in claim 1.

* * * * *